United States Patent [19]

Pearson et al.

[11] 4,426,873

[45] Jan. 24, 1984

[54] DEFLECTION COMPENSATING MEANS FOR PRESS BRAKES AND THE LIKE

[75] Inventors: Eugene W. Pearson, Pebble Beach; Arthur L. Pedersen, Oakland, both of Calif.

[73] Assignee: Canron Corporation, Oakland, Calif.

[21] Appl. No.: 369,183

[22] Filed: Apr. 16, 1982

[51] Int. Cl.[3] ..... B21D 5/02

[52] U.S. Cl. ..... 72/389; 72/448

[58] Field of Search ..... 72/389, 386, 448, 465, 72/446

[56] References Cited

U.S. PATENT DOCUMENTS 2,199,864 5/1940 Wehr ..... 72/448

4,106,323 8/1978 Haenni ..... 72/448

4,347,727 9/1982 Galiger ..... 72/389

4,354,374 10/1982 Deguchi ..... 72/389

*Primary Examiner*—Gene P. Crosby

*Attorney, Agent, or Firm*—Manfred M. Warren; Robert B. Chickering; Glen R. Grunewald

[57] ABSTRACT

A flexible wedge for use under the die of a press to compensate for deflection of the die when force is exerted against it, the wedge being elongated and tapering across its width and having graded flexibility along its length with the portions nearer the ends of the wedge being more flexible in order for the wedge to deflect as a uniformly load beam when a concentrated force is applied at its center to position it under a die.

14 Claims, 19 Drawing Figures

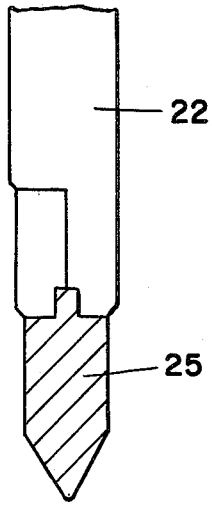
FIG _ 9
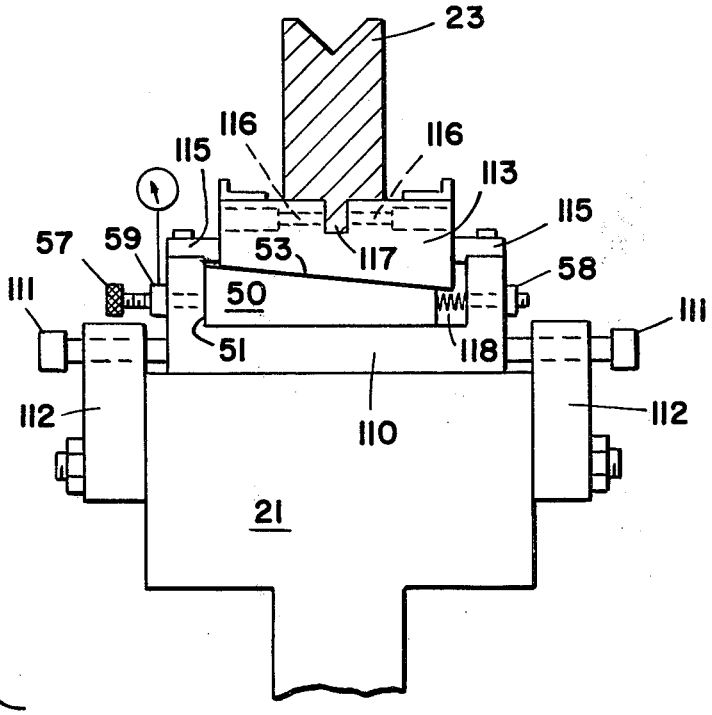

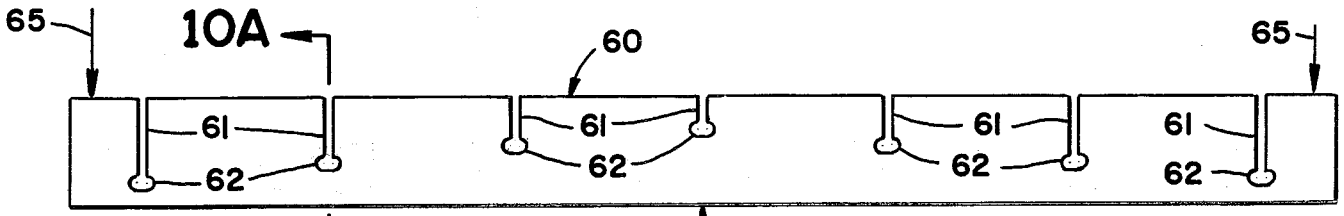
FIG_10
FIG_10A
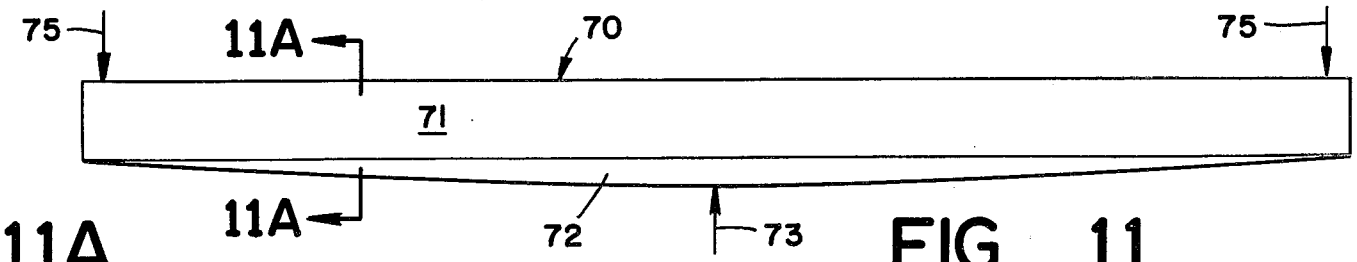
FIG_11
FIG_11A
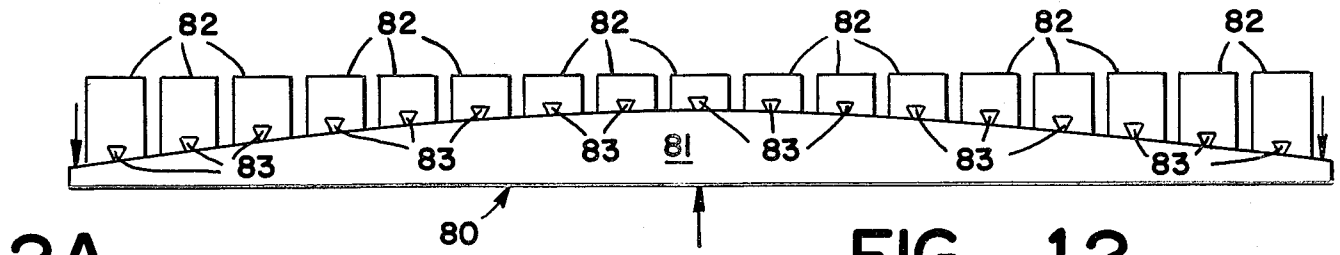
FIG_12
FIG_12A

DEFLECTION COMPENSATING MEANS FOR PRESS BRAKES AND THE LIKE

BACKGROUND OF THE INVENTION

Hydraulic and mechanical presses are used, among other things, for bending long metal sheets or plates. The metal being bent is called a workpiece. Bending is accomplished by placing the workpiece between a male die and a female die and bringing the dies together with sufficient force to bend the workpiece. One die is on a moveable member called a ram and the other is fixed to the bed of the press. The ram and bed of the press are designed very heavy structurally so as to provide rigidity to the dies.

Except for bending very thin material, most long sheet or plate bending is accomplished by the "air bending" concept which is also called three-point bending. In air bending, the male die forces the workpiece over the two contact points of the female die and the angle of the bend is established by how far the nose of the male die enters the female die with the workpiece between them. Very small variations in the distance the male die penetrates will cause significant variations in the angle of the bend of the workpiece. For example, for a one-inch female die opening, a difference of 0.02 inches is how far the nose of the male die enters the female die will cause a difference of 2.2 degrees in the angle of the bend.

Particularly when bending long workpieces, tremendous force, ranging from 3 to 50 tons per foot of length for steel, is needed to bend the workpiece. This great force causes the ram and bed members of the press to deflect much as a loaded beam will deflect. Although the actual amount of deflection may be relatively small, as indicated above, it causes the angle in the workpiece to vary along its length, and since loading beams deflect more in their centers than toward their edges, the workpiece bent without some type of deflection compensation will have an unequal angle of bend along its length and will be underbent or "bellied" toward the center. Such bend angle error is many times unsatisfactory. For example, if a bent plate is to be welded to an adjacent plate that is flat, the "bellied" edge creates a very difficult fit-up and welding problem.

Many devices have been used to compensate for press deflection. Probably the most common way to deal with deflection is to shim the die progressively between its center and its ends. Shims are time consuming to install because they must be placed by hand, and shims do not produce predictable and reproduceable results because shimming is largely based on a trial and error procedure.

Another technique to avoid adverse consequences of deflection is to crown the ram or bed of the press, or to use an intermediate die holder with varying thickness that approximates the expected deflection of the press when force is applied to the workpiece. The problem with crowning is that the crown compensates for deflection for only one load condition, and for every other load condition a problem is caused by too much or too little crowning.

Another technique to deal with deflection is to use a number of individual transverse wedge blocks that can be inserted between the die and a bolster. These wedge blocks can be inserted under the die individually to a position that compensates for the deflection of the press. As with shims, individual wedge blocks must be individually positioned by hand, and their placement is based largely on trial and error, and is time consuming.

Other techniques to deal with press deflection are to use a die holder of trapped elastic materials such as rubber or plastic, or to support a die on fluid such as oil that supports the die through a hydraulic cylinder or a diaphragm. These methods require complex and expensive equipment which requires frequent maintenance and replacement.

SUMMARY OF THE INVENTION

This invention is a device to compensate for the deflection of a beam, particularly a beam supporting a die of a press used to bend a workpiece. In its broadest aspect, the device of this invention is an elongated compensating wedge tapering across its width and having its flexibility graded along its length in a manner such that it is more flexible toward its ends than it is in its center. The flexibility gradations are preferably designed such that when the compensating wedge is loaded with a single concentrated force at its center, it will deflect beneath a die in a manner to match the deflection of the press, which is usually characteristic of deflection of a uniformly loaded beam.

With minor variations due to the particular structure of a press, the ram and bed of a press deflect as uniformly loaded beams. When one or more wedges are used to compensate for deflection, the center of the die should be held higher than its ends, and the variation in height is a function of how far the wedge or wedges are positioned beneath the die. If a single, elongated, flexible wedge has its ends restrained and its center moved beneath a die the wedge will deflect as a beam having a concentrated load, which is quite different from the deflection of a uniformly loaded beam. The deflection of a beam caused by a concentrated load is characterized by the center of the beam being deflected more than if that same load were supported uniformly over the beam. Thus, if a single, elongated flexible wedge is forced beneath a die by force applied at a single central point in order to compensate for the deflection of the uniformly loaded press, the center of the wedge will be too far beneath the center of the die and will provide too much "rise" in the center of the die to accurately compensate for the deflection of the uniformly loaded press members. Alternatively, if concentrated force compensates properly for deflection at the center of the die there will not be enough "rise" at the ends of the die to compensate for deflection.

The compensating wedge of this invention is constructed to have graded flexibility along its length whereby it is more flexible at its ends than it is in its center. The graded flexibility is adjusted so that when the ends of the wedge are restrained and a concentrated force is used to position the wedge beneath the die, the wedge deflects beneath the die as a uniformly loaded beam. The graded flexibility of the compensating wedge of this invention can also be adjusted to cause it to deflect in a manner tailored to the actual deflection characteristics of the press with which it is used, thereby to compensate exactly for deflection of that specific press. The device of this invention may also be programmed to automatically compensate for deflection responsive to the force selected to bend a workpiece.

BRIEF DESCRIPTION OF THE DRAWINGS

FIG. 9 is a partial sectional view of a ram and bed embodying this invention.

FIG. 10 is a flexible wedge member embodying this invention.

FIG. 10A is a cross-section taken along the line 10A—10A of FIG. 10.

FIG. 11 is a flexible wedge member embodying this invention.

FIG. 11A is a cross-section taken along the line 11A—11A.

FIG. 12 is another flexible wedge member embodying this invention.

FIG. 12A is an end view of the wedge illustrated in FIG. 12.

DETAILED DESCRIPTION OF THE DRAWING

Figure 1:
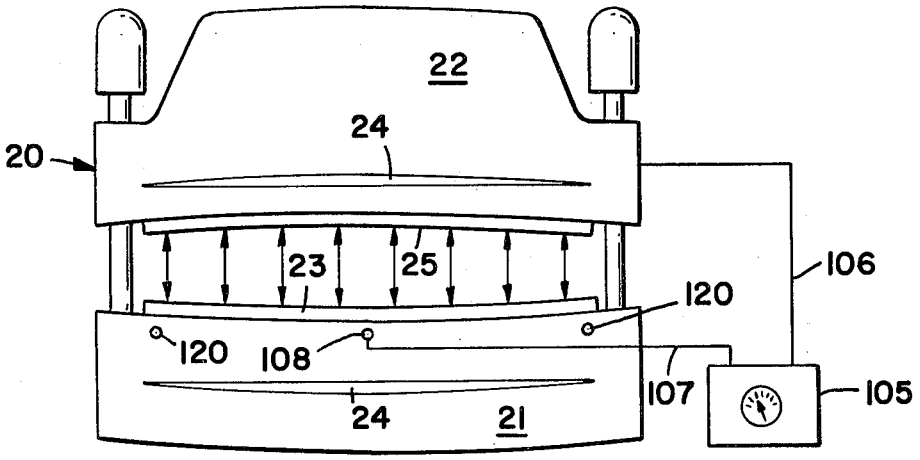
FIG. 1 is a simplified elevation view of a press employed for bending workpieces.

FIG. 1 is a simplified view of a press that would employ a compensating wedge assembly of this invention. The press of FIG. 1 illustrates, in exaggerated detail, the deflection resulting from bending a workpiece. The press illustrated in FIG. 1 generally designated 20 and it consists of a bed element 21 and a ram element 22. A die 23 is mounted on the bed and a die 25 is mounted on the ram. Ordinarily, the female die is fixed to the bed and the male die is fixed to the ram.

Figure 6:
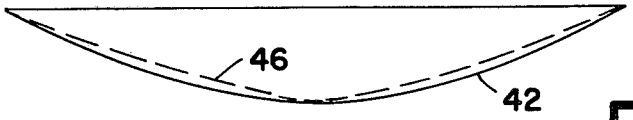
FIG. 6 is a plot of deflection versus distance from the center of a beam for a beam supporting uniformly distributed force and for a beam supporting concentrated force.

When bending a workpiece between the male and the female dies, the bed 21 and ram 22 are loaded uniformly. That is, approximately the same force will be supported by each increment of the length of the press members. The ram and the bed act as beams and, as illustrated in exaggerated detail, they deflect as beams, roughly as shown. The difference between the loaded and unloaded shapes of the ram and bed are shown at 24. The bending force (illustrated by arrows between the dies) causes the ram to deflect upwardly toward its center and the bed to deflect downwardly toward its center. Typical deflection curves for the bed and frame members are illustrated in FIG. 6 and will be discussed in more detail hereinafter.

Figure 2:
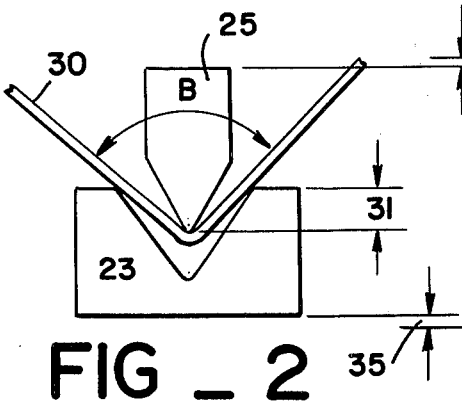
FIG. 2 is a cross section of two dies and a workpiece located toward the end of the dies during a bending operation.
Figure 2A:
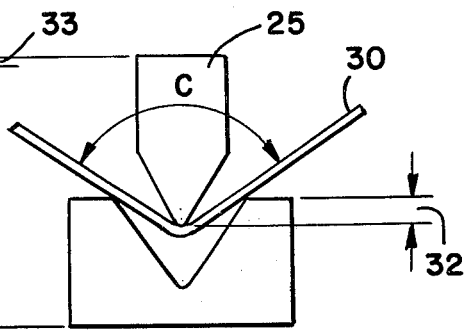
FIG. 2A is a cross section of the same dies and workpiece illustrated in FIG. 2 but taken at the center of the dies.

FIGS. 2 and 2A illustrate the relationships among the male die 25, the female die 23, and the workpiece 30 during a bending operation. FIGS. 2 and 2A illustrate "air bending" wherein only the nose of the male die touches the workpiece and only the upper corners of the female die touch the workpiece. The angle of the bend, is a function of die penetration.

FIG. 2 illustrates bending at the end of the die and die penetration in FIG. 2 is the distance 31. FIG. 2A illustrates bending at the center of the die and die penetration in FIG. 2A is the distance 32. Distance 32 is smaller than distance 31 because, toward the center of the die, deflection of the bed and the ram, and accordingly the dies supported by the bed and the ram, is greater. Thus, at the center of the die the amount of deflection of the ram is illustrated as the distance 33 and the amount of deflection of the bed is illustrated as distance 35, and the sum of the distances 33 and 35 is the the difference between die penetration 31 and die penetration 32. It is evident that the angle C in FIG. 2A is more obtuse than the angle B in FIG. 2 because the angle of the bend is a function of die penetration, and die penetration toward the center of the die is less due to deflection of the press.

Figure 3:
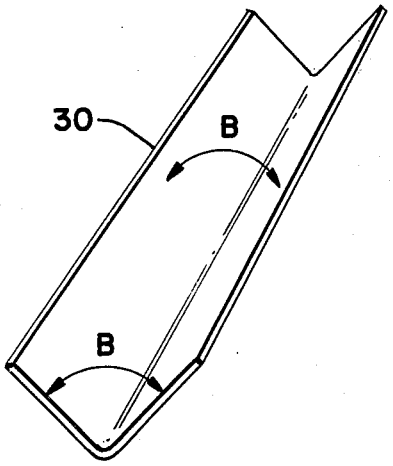
FIG. 3 illustrates in perspective view the desired bend of a workpiece.
Figure 4:
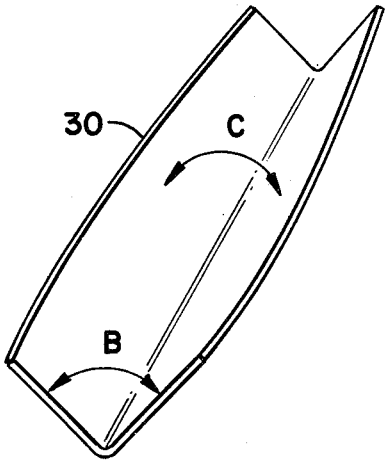
FIG. 4 illustrates in perspective view the typical bend of a workpiece that results from deflection of the press.
Figure 5:
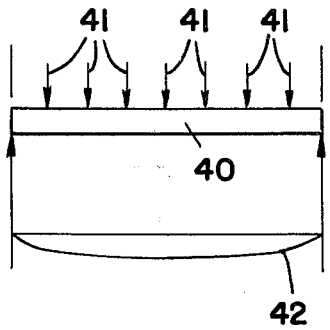
FIG. 5 illustrates, schematically, typical deflection characteristics of a beam loaded with a uniformly distributed force.
Figure 5A:
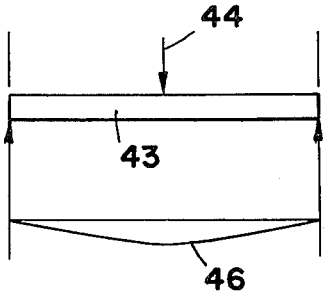
FIG. 5A illustrates, schematically, typical deflection characteristics of a beam loaded with a concentrated force.

FIGS. 3 and 4 illustrate the problem caused by deflection. FIG. 3 shows a workpiece 30 having the desired bend wherein the angle B at the end of the workpiece is the same as the angle B at its center. When die penetration varies along the length of the bend, the angle B at the end of the workpiece is different from the angle C at the center of the workpiece which results in a bowed or bellied-out portion of the workpiece. This is illustrated in FIG. 4. The angle of the bend varies gradually and in accordance with the deflection curve of a press. FIGS. 5, 5A and 6 illustrate different deflections caused when a beam is uniformly loaded and when it is loaded with a concentrated force. FIG. 5 schematically illustrates a beam 40 loaded with uniformly distributed force wherein each length increment of the beam supports the same amount of force. The arrows 41 represent force on the beam. The deflection curve of such a beam is illustrated in FIG. 5 at 42 and at the solid line 42 in FIG. 6.

FIG. 5A illustrates, schematically, a beam 43 loaded with a concentrated force 44. The deflection curve for such a beam is illustrated in FIG. 5A at 46 and the dashed line 46 in FIG. 6. It is evident from FIG. 6 that the deflection curve of a uniformly loaded beam is much steeper at its ends and much flatter in its center than the deflection curve for a beam loaded with concentrated force, and this difference in deflection curves produces a problem in compensating for deflection with a continuous, elongated, flexible wedge. The single force application urging the wedge beneath the die causes the wedge to deflect beneath the die in the manner of a beam supporting concentrated force whereas the die deflects in the manner of a beam supporting uniformly distributed force. If the compensating wedge is to compensate for deflection of a uniformly loaded beam, it should be deflected beneath the die on a curve that approximates the deflection curve of a uniformly loaded beam.

Figure 7:
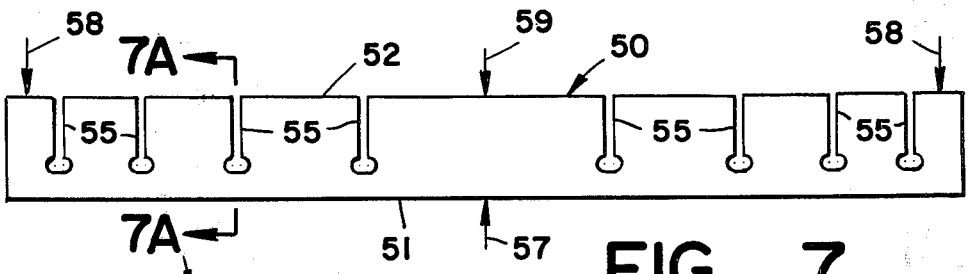
FIG. 7 is a plan view of one species of compensating wedge embodying this invention.
Figure 7A:
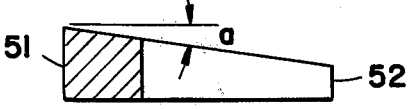
FIG. 7A is a cross-section taken through 7A—7A of FIG. 7.
Figure 8:
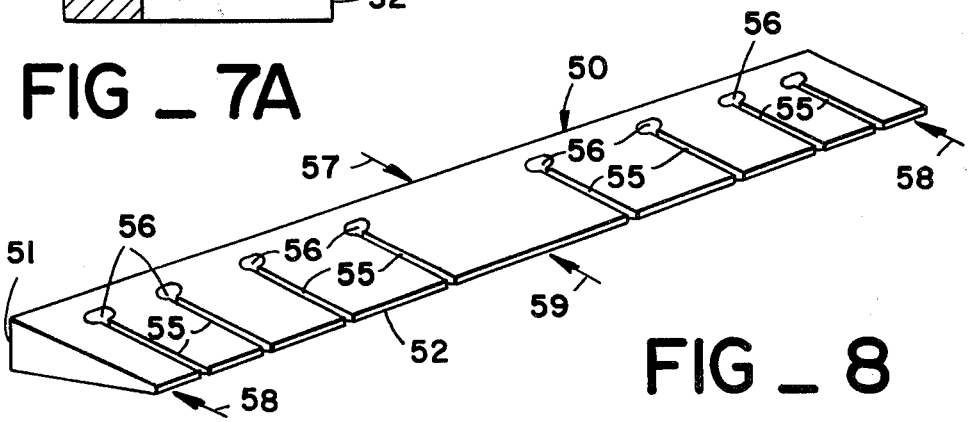
FIG. 8 is a perspective view of the device illustrated in FIG. 7.

To accomplish this end, the compensating wedges of this invention are constructed with graded flexibility along their length so that they deflect in the manner of a uniformly loaded beam when a concentrated force is applied to them. Wedges having graded flexibility can be prepared in a number of ways. One such wedge is illustrated in FIGS. 7, 7A and 8. FIG. 8 illustrates the wedge, generally designated 50, in perspective view. The wedge has a thick edge 51, a thin edge 52 and a flat, tapering upper face 53. The wedge is provided with a number of slots 55 which penetrate the thin edge 52 and extend to enlarged openings 56 that are spaced from the thick edge 51 of the wedge. In the embodiment shown in FIGS. 7, 7A and 8, the spacing between adjacent slots 55 varies along the length of the wedge with slots toward the center of the wedge being spaced farther from each other than slots toward the edge. As a result, the flexibility of the wedge when it is urged by a centrally applied force, illustrated generally by the arrow 57, and restrained on its ends by forces illustrated generally as 58, varies along its length with the wedge being more flexible toward its ends than in the center. As a result, the application of forces 57 and 58 will cause the wedge 50 to deflect on a curve that approximates a uniformly loaded beam even though deflection is caused by a concentrated force 57.

The wedge angle "a" shown in FIG. 7A is selected to be a non-slip wedge angle. If the tangent of angle "a" is less than the coefficient of friction of the sliding surfaces, then the wedge angle is such that the wedge will not slip regardless of the vertical force applied by the press.

When the device of this invention is employed with a press that has a crown to compensate for deflection, it is preferred that force exerting means 59 be provided to exert a deflecting force against the thin edge and toward the thick edge of the wedge. Deflecting the wedge in this direction permits the flexible wedge to compensate for overcrowning when less ram force is used than the crown is designed to compensate for.

Due to differences in cross section of different parts of the ram and bed members, many presses have deflection curves that vary from the true deflection curve of a uniformly loaded beam. These individual deflection characteristics can be readily duplicated by arranging the spacing of slots 45 to grade the flexibility of the compensating wedge to match the deflection curve of the particular press with which it is used. Such a tailored wedge will be capable of compensating for any force used to bend a workpiece by being positioned a greater or lesser distance beneath the die because its deflection characteristics distance beneath the die because its deflection characteristics match those of the press.

The wedge illustrated in FIGS. 7, 7A and 8 is only one embodiment of the invention. Wedges with graded flexibility can be prepared in a number of other configurations. Other wedges having graded flexibility are illustrated in FIGS. 10 through 13.

The wedge element of FIGS. 10 and 10A is generally illustrated as 60 and it contains a number of equally spaced slots 61 that are of varying depth. Deeper slots located toward the end of the wedge cause the wedge to be more flexible toward its ends than it is toward its center. FIG. 10A illustrates a section of the wedge taken along the line 10A—10A of FIG. 10. FIG. 10 illustrates that slots 61 are cut in the thin edge of the wedge. Cutting slots through the thin edge of the wedge is a preferred embodiment of the invention but not an essential one. The slots in wedge 60 are provided with enlarged openings 62 to increase the flexibility of the wedge when force 63 is applied while the ends are restrained by forces 65.

FIGS. 11 and 11A illustrate a wedge having greater flexibility toward its ends than at its center. The wedge 70 has a portion 71 tapering across its width which is employed to compensate for deflection of the press. A spine portion 72 is constructed to be wider in the center than toward the edges so that the entire wedge element has a tapering cross section and therefore a graded flexibility resisting the deflecting forces 73 and 75. As a result, the wedge illustrated in FIGS. 11 and 11A is more flexible toward its ends than toward its center, and when a concentrated force 73 is applied to bend it, it will deflect as a uniformly loaded beam.

FIGS. 12 and 12A illustrate another wedge 80 embodying this invention. The wedge 80 is constituted of a spine portion 81 with tapering width to which a plurality of wedge shaped teeth 82 are connected with means such as dove tail connections 83. Thus, the graded flexibility of the device illustrated in FIGS. 12 and 12A is accomplished by the spine 81 having varying width along its length and the individual wedge elements 82 are positioned beneath the die by a concentrated force different distances in accordance with the deflection characteristics of the spine 81. The spaces between adjacent wedge elements 82 are small enough to provide the equivalent of continuous support beneath a die or a die holder whereby the deflection of the press is continuously compensated for by a wedge that provides support corresponding to the deflection of the press.

Figure 13:
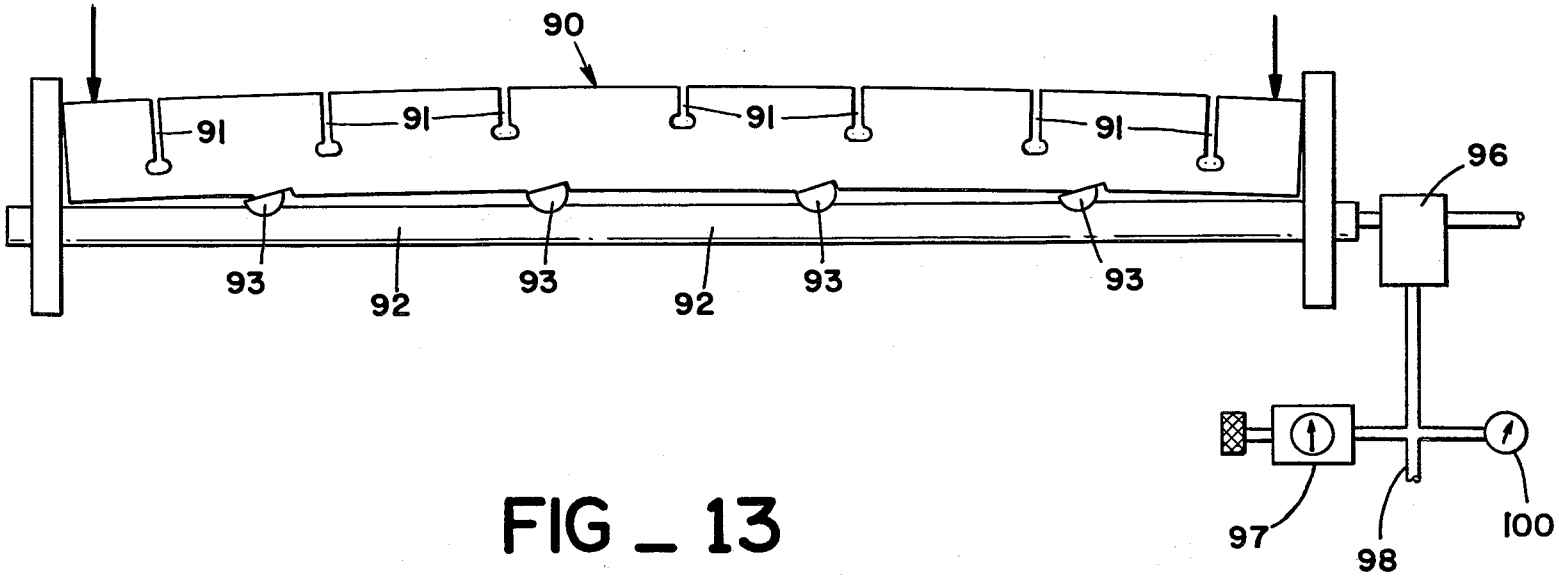
FIG. 13 is another flexible wedge member embodying this invention.

FIG. 13 illustrates another device for deflecting a wedge beneath a die or die holder in a manner that provides compensation for the deflection characteristics of the press. The compensating wedge element of FIG. 13, is identified generally as 90, and it is prepared with slots 91 that intersect its thin edge and are illustrated as being equally spaced and of different depths to provide graded flexibility. A bar 92 having self-aligning cam elements 93 carried in appropriate recesses is provided behind the thick edge of the wedge element 90. The thick edge of the wedge 90 is provided with ramped portions 95 which are at different angles with the steepest angles being toward the center of the wedge 90 and the shallower angles being toward its edges. Bar 92 is provided with force exerting means such as a manually operated screw of a hydraulic motor generally illustrated as 96 which is connected, to move rod 92 longitudinally. Motion of rod 92 to the left will drive cam elements 93 to the left and will cause the wedge 90 to deflect a greater distance while movement of rod 92 to the right will cause ramps 95 to ride down on cam elements 93 which will reduce the amount of deflection of wedge 90.

FIG. 13 illustrates an embodiment of the invention in which the force used to drive the ram can be fed into a device 97 that causes the pressure of hydraulic fluid provided through line 98, supplying the motive force for the hydraulic motor 96, to drive the rod 92 to the left the amount required to deflect wedge 90 the correct amount to compensate for deflection of the press. Indicator 100 can be calibrated to indicate hydraulic pressure, the distance bar 92 is displaced from a null position, or the deflection of wedge 90 beneath the die.

A preferred embodiment of the invention is illustrated in FIG. 1. A computing means generally designated 105 is employed to select the hydraulic pressure in line 106 needed to move ram 22 against bed 21 with sufficient force to bend a workpiece positioned between die 23 and die 25. Contemporaneously with establishing the required pressure in line 106 to move the ram 22 with sufficient force to bend the workpiece but before the dies actually come together, a pressure is established in line 107 that actuates force exerting means 108 to deflect the wedge beneath the die far enough to compensate for the deflection of the press caused by the bending force exerted by ram 22. This embodiment provides automatic compensation for different press deflections experienced at different ram forces and will virtually eliminate problems due to deflection of the press members.

FIG. 9 illustrates in partial cross section, the invention installed in an environment of use. The bed 21 of the press has a bolster base plate 110 placed upon it and held against horizontal motion with set screws 111 which are in turn positioned in threaded openings in side retaining plates 112 which are bolted to the bed 21. The bolster base plate 110 has a horizontal upper surface upon which a flexible elongated wedge 50 is positioned. The flexible elongated wedge 50 is illustrated before any deflection compensation motion is achieved and it is flat against the vertical side of base plate 110. One set screw 58 is positioned at each end of wedge 50 to restrain the ends from moving forward when the wedge 50 is urged beneath die holder 113. The force to urge elongated wedge 50 beneath the die holder is provided by force exerting means 57 which is illustrated here as a manually activated threaded member but, as disclosed above, may be a hydraulic or pneumatic device, and which may be automatically or manually controlled. The manually activated force exerting means 57 is provided with a means 59 to indicate the transverse deflection of the center of wedge 50 beneath die holder 113.

Die holder 113 has a diagonal bottom surface that is at an angle to coincide exactly with the upper surface 53 of elongated wedge 50. Die holder 113 is restrained against horizontal motion by clamping elements 115 which are held to the base plate 110 with bolts or other appropriate means. With this arrangement, die holder 113 is free to float vertically but it is restrained from any horizontal movement either by operation of force-exerting means 57 or by operation of the ram 22 and male die 25. The position of female die 23 is finally adjusted by set screws 116 acting against the tongue 117 that fits in an appropriate groove in die holder 113.

When a workpiece is to be bent, the force required to effect the bend is determined and force-exerting means 57 is operated to force the center of elongated wedge 50 beneath die holder 113 the appropriate distance. If the force-exerting means is a manually operated threaded element, it may be calibrated so that each revolution of the threaded element will position the center of wedge 50 further beneath die holder 113 an amount to compensate for an increment of bending force. This calibration may easily be made by taking into account the deflection of the press per unit of force, the rise of the wedge 50 per unit of length of travel, and the pitch of the thread in force-exerting means 57. With set screws 58 restraining movement of the ends of wedge 50, operation of force-exerting means 57 will cause the center of wedge 50 to travel farthest beneath die holder 113 and each intermediate length increment of wedge 50 will travel a lesser distance beneath to support die holder 113 in accordance with the known deflection curve of the press. It is preferred that a centrally located restraining bolt aligned with restraints 58 be employed to avoid over travel of the center of wedge 50, and it is preferred that a spring or other force-exerting means 118 be provided to urge the center of wedge 50 in a direction opposite the direction of movement caused by force-exerting means 57. When a force-exerting means 118 is employed to compensate for over-crowning, then the thick edge 51 of the wedge 50 must be moved away from the wall of the base 110 and restrained against horizontal motion toward the left as illustrated in FIG. 9. Such restraints may be analogous to restraints 58 and will be positioned as indicated in FIG. 1 at 120. Positioning of the compensating wedge is always done before force is exerted against a workpiece.

FIG. 9 further illustrates that a single compensating wedge 50 may be employed to compensate for the deflection both of the ram and of the bed of a press. It is not necessary that both male die 25 and female die 23 be straight during a bending operation, as long as they are bowed by deflection and the compensating wedge to be parallel. Thus, if female die 23 were bowed upwardly by wedge 50 the same amount that male die 25 is bowed upwardly by deflection of the ram 22, a straight bend as illustrated in FIG. 3 may be obtained.

What is claimed is:

1. A device to compensate for deflection of a beam to support an elongated die comprising:

a. a elongated wedge tapering across its width to provide a thick edge and a thin edge, b. means providing an inherently graded flexibility along the length of the wedge, said means providing greater flexibility toward the ends of the wedge, c. a wedge supporting surface between said beam and said die, d. a restraint engaged with each end of said wedge, said restraint positioned to limit the movement of said wedge between the beam and the die, and e. means for exerting force horizontally against the thick edge of said wedge and toward the thin edge of said wedge, said force being applied intermediate the restrained ends of said wedge.

2. The device of claim 1 wherein the means for exerting force acts to exert a single, concentrated force at the center of the thick edge of said wedge.

3. The device of claim 1 wherein said means providing graded flexibility comprises slots intersecting the thin edge and terminating short of the thick edge, said slots being more closely spaced toward the ends of said wedge.

4. The device of claim 3 with said slots terminating in enlarged openings at the ends of said slots farthest from the thin edge of said wedge.

5. The device of claim 1 wherein said means providing graded flexibility comprises evenly spaced slots intersecting said thin edge, with the slots closer to the ends of the wedge being deeper.

6. The device of claim 5 with said slots terminating in enlarged openings at the ends of said slots farthest from the thin edge of said wedge.

7. The device of claim 1 wherein said means providing graded flexibility comprises a wedge portion of tapering thickness and a spine portion of tapering width.

8. The device of claim 7 wherein said wedge portion comprises individual wedge elements removably connected to said spine portion.

9. The device of claim 1 with force exerting means acting midway between the ends of said wedge.

10. The device of claim 1 wherein the flexibility of said elongated wedge is graded to deflect as a uniformly loaded beam.

11. The device of claim 1 wherein said wedge is tapered at a non slip wedge angle.

12. The device of claim 1 wherein the force exerted by said force exerting means is controlled responsive to the force employed to deflect said beam.

13. The device of claim 1 including a second force exerting means positioned to exert a force against the thin edge of said wedge and toward the thin edge of said wedge, said second force exerting means applying force intermediate the restrained ends of said wedge.

14. A device to compensate for the deflection of a beam to support an elongated die comprising an elongated wedge tapering across its width and having means to provide an inherently graded flexibility along its length, said means providing greater flexibility toward the ends of said wedge.

* * * * *